United States Patent [19]

Minowa et al.

[11] Patent Number: 4,909,212

[45] Date of Patent: Mar. 20, 1990

[54] ELECTRONICALLY CONTROLLED TYPE THROTTLE VALVE FOR INTERNAL COMBUSTION ENGINES

[75] Inventors: Toshimichi Minowa, Ibaraki; Yoshishige Ohyama, Katsuta, both of Japan

[73] Assignee: Hitachi, Ltd., Tokyo, Japan

[21] Appl. No.: 324,042

[22] Filed: Mar. 16, 1989

[30] Foreign Application Priority Data

Mar. 18, 1988 [JP] Japan ..... 63-63527
Aug. 29, 1988 [JP] Japan ..... 63-212471

[51] Int. Cl.[4] ..... F02D 9/16

[52] U.S. Cl. ..... 123/337; 123/399; 137/625.32; 251/129.06; 251/129.11

[58] Field of Search ..... 123/337, 361, 399, 403; 137/625.32, 625.31; 251/129.06, 129.11, 129.12

[56] References Cited

U.S. PATENT DOCUMENTS 691,529 1/1902 Brophy ..... 137/625.32
1,664,747 4/1928 Kamensky ..... 123/337
1,948,840 2/1934 Biddle ..... 137/625.31
3,224,424 12/1965 Mennicken et al. ..... 137/625.31
4,112,901 9/1978 Chapin et al. ..... 123/337

FOREIGN PATENT DOCUMENTS 3718544 12/1988 Fed. Rep. of Germany ..... 123/403
61-229935 10/1986 Japan .
62-129529 6/1987 Japan .
63-101584 5/1988 Japan ..... 251/129.11

*Primary Examiner*—Andrew M. Dolinar
*Attorney, Agent, or Firm*—Antonelli, Terry & Wands

[57] ABSTRACT

An electronically controlled type throttle valve for an internal combustion engine is arranged within a suction passage of the engine. An opening degree of the throttle valve is controlled in response to a running condition of the engine to be controlled or an amount of depression of an accelerator pedal, thereby controlling an amount of suction air. The throttle valve comprises a stationary section and a movable section. The stationary section is fixedly arranged within a suction passage in concentric relation thereto, and is composed of a tubular member whose one end is closed. A gas flow passage is defined between a peripheral wall of the stationary section and the suction passage. The peripheral wall is formed with at least one pair of openings. The movable section is fitted in the stationary section in concentric relation thereto for sliding movement relative to the stationary section. The movable section has a peripheral wall provided with openings corresponding respectively to the openings formed in the peripheral wall of the stationary section. A motor is arranged to impart rotative driving force to the movable section. The suction passage is controlled in area by a rotational position of the movable section relative to the stationary section, thereby controlling the amount of suction air.

6 Claims, 20 Drawing Sheets

ELECTRONICALLY CONTROLLED TYPE THROTTLE VALVE FOR INTERNAL COMBUSTION ENGINES

BACKGROUND OF THE INVENTION

The present invention relates to a so-called throttle valve for controlling an amount of suction air supplied to an interal combustion engine of an automotive vehicle or the like and, more particularly, to an electronically controlled type throttle valve for internal combustion engines, in which an opening degree of the throttle valve is controlled electronically through an actuator.

For a gasoline engine of an automotive vehicle, or the like, for example, there are various severe demands on running controllability, exhaust gas characteristics, fuel consumption characteristics and so on. In view of these severe demands, in recent years, there is such a tendency as to employ the following system. That is, an opening degree of a throttle valve is controlled in mechanically interlocked relation to an accelerator pedal, as has conventionally been employed widely. In addition thereto, various data required for controlling the engine, including the operating condition of the accelerator pedal, are once inputted to an electronic control system composed of, for example, a microcomputer or the like. Subsequently, the opening degree of the throttle valve is controlled on the basis of a control signal from the electronic control system through a predetermined electric actuator. Specifically, a system has already been proposed in, for example, Japanese patent application Laid-Open No 61-229935 or the like, in which an actuator operated by a DC motor is used to effect control of opening and closing of the throttle valve.

A system is also known from, for example, in Japanese patent application Laid-Open No. 62-129529 or the like, in which a stepping motor is utilized as a driving source, and rotational force of the driving stepping motor is transmitted to a shaft of the throttle valve through a reducing gear mechanism.

In the electronically controlled type throttle valve of the kind referred to above, the electric motor or the like serving as the actuator is driven in response to an amount of change of the accelerator pedal and, in addition thereto, the throttle valve can be corrected and controlled in accordance with the running conditions of the engine. Thus, the throttle valve has such an advantage that the running controllability of the engine can be raised.

By the way, the conventional electronically controlled type throttle valve described above employs a system in which a so-called butterfly valve having a so-called single disc mounted on a shaft for rotation is used, and the butterfly valve is drivingly operated by the electric actuator mounted on the outside of the throttle body.

In the butterfly valve described above, however, the requisite operational torque varies considerably depending upon the throttle opening degree or an angle of the valve. This is due to torque produced by air flowing through the throttle body. In addition, the above-mentioned butterfly valve is provided with a return spring for returning the valve always toward the fully closed position. By this return spring, the operational torque required for controlling the opening degree of the butterfly valve is brought to a considerably large value. This raises such problems that it is made difficult to reduct the capacity of the electric actuator for generating the operational torque, it is made difficult to reduce the size the throttle body, and it is made difficult to accommodate the throttle valve in the engine room which has such a recent tendency as to be reduced more and more.

SUMMARY OF THE INVENTION

It is therefore an object of the invention to provide an electrically controlled type throttle valve for an internal combustion engine, in which operational torque for the valve is relatively low so that miniaturization of driving means is facilitated and, in addition thereto, the valve is small in overall size and is superior in mounting ability.

For the above purpose, according to the invention, there is provided an electronically controlled type throttle valve for an internal combustion engine, the throttle valve being arranged within a suction passage of the engine and having an opening degree controlled in response to any one of a running condition of the engine to be controlled and an amount of operation of an accelerator pedal, to control an amount of suction air, the throttle valve comprising:

a stationary section fixedly mounted within the suction passage in concentric relation thereto and including a tubular member whose at least one end is closed, the stationary section having a peripheral wall whose outer surface cooperates with an inner peripheral surface of the suction passage to define therebetween a gas flow passage, the peripheral wall being formed with at least one pair of openings arranged in symmetrical relation to each other with reference to an axis of the peripheral wall, the openings being symmetrical in configuration to each other;

a movable section fitted in the stationary section in concentric relation thereto for sliding movement relative to the stationary section, the movable section having moving walls which correspond respectively to the openings formed in the peripheral wall of the stationary section, the moving walls being arranged in symmetrical relation to each other with reference to a rotary axis of the movable section, the moving walls being symmetrical in configuration to each other; and rotative driving means for imparting rotative driving force to the movable section, wherein a suction passage formed between the openings in the stationary section and the moving walls of the movable section is controlled in area by a position of the movable section relative to the stationary section.

It is desirable that the rotative driving means is fixedly mounted to a part of the stationary section, and may be constituted by a rotary electric motor. It is particularly desirable that the rotary electric motor is a ultrasonic motor.

Further, the electronically controlled type throttle valve can be incorporated in a surge tank of the internal combustion engine.

If the electronically controlled type throttle valve is arranged within the suction passage of the internal combustion engine, pressures applied respectively on the moving walls of the movable section are canceled out each other, because the moving walls are arranged in symmetric relation to each other. Thus, the force required for rotatively driving the movable section does not depend upon the opening degree of the throttle valve, but is always made substantially constant. Further, the force is brought to a considerably small value, as compared with a case where the conventional butterfly valve is employed.

Therefore, small capacity will suffice for the rotative driving means for rotatively driving the movable section, making it possible to miniaturize the rotative driving means and, in turn, to miniaturize the entire throttle valve and to improve the mounting ability.

It is desirable that the rotative driving means is incorporated in the stationary section, from the viewpoint of miniaturization of the entire throttle valve. Further, it is desirable that the ultrasonic motor is employed to increase the driving torque.

Furthermore, incorporation of the throttle valve in the surge tank of the internal combustion engine makes it possible to mount the throttle valve within the narrow engine room.

BRIEF DESCRIPTION OF THE DRAWINGS

FIG. 22B being the cross-sectional view taken along the line XXIIB—XXIIB in FIG. 22A;

DETAILED DESCRIPTION OF THE PREFERRED EMBODIMENTS

An electronically controlled type throttle valve for internal combustion engines, according to the invention, will be described below with reference to the accompanying drawings.

Prior to description of an embodiment of the invention, the construction, the principle and operational characteristics of a coaxial rotary throttle valve on the basis of a fundamental feature of the invention, as well as comparison results between the invention and the previously mentioned conventional butterfly valve will be described.

Figure 23A:
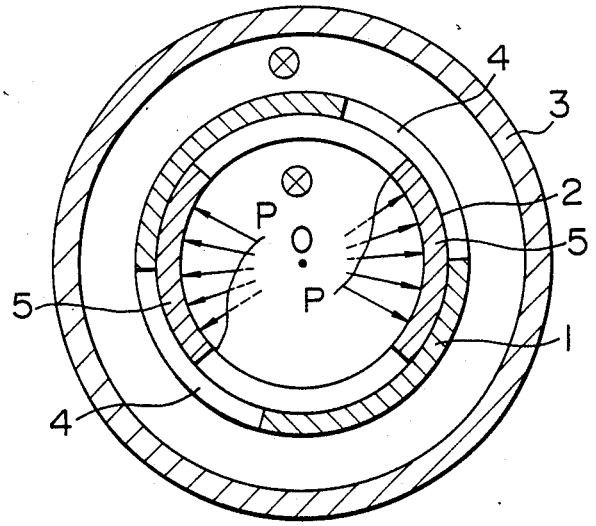
FIGS. 23A and 23B and FIGS. 24A and 24B are views for explanation of the fundamental construction and characteristics of a coaxial rotary valve which is employed in the electronically controlled type throttle valve for internal combustion engines, according to the invention, in comparison with the conventional butterfly valve.

FIG. 23A shows the fundamental construction of the coaxial throttle valve employed as the electronically controlled type throttle valve for internal combustion engines, according to the invention. That is, the throttle valve is composed of a cylindrical stationary section 1 and a movable section 2 fitted about the stationary section 1 for sliding movement relative thereto. The stationary section 1 is formed by a cylindrical member as described previously, and has one end closed and the other end provided with a flange. The stationary section 1 is fixed within a throttle body 3 of the internal combustion engine by means of the flange. The stationary section 1 has a cylindrical wall whose outer surface cooperates with an inner peripheral surface of the throttle body 3 to define therebetween a flow passage for air. The flow passage communicates fluidly with a space (flow passage for air) defined by an inner surface of the cylindrical wall of the stationary section 1, through a pair of openings 4 and 4 provided in the cylindrical wall. The pair of openings 4 and 4 are formed in the cylindrical wall at respective locations symmetrical to each other with reference to a rotary axis of the cylindrical wall, and with their respective configurations symmetrical to each other.

On the other hand, the movable section 2 is rotated slidingly within the cylindrical stationary section 1 by a rotary drive section which is not shown in the figure. The movable section 2 is formed on its outer periphery with a pair of moving walls 5 and 5 which are arranged at their respective positions symmetrical to each other with reference to the rotary axis, correspondingly respectively to the openings 4 and 4 formed in the cylindrical wall of the stationary section 1. The moving walls 5 and 5 have their respective configurations symmetrical to each other. The movable section 2 is slidably inserted in the cylindrical wall of the stationary section 1. With such arrangement, as shown also in the figure, the openings 4 and 4 in the stationary section 1 and the moving walls 5 and 5 of the movable section 2 cooperate with each other to form a valve for suction air. Thus, rotation of the movable section 2 causes an overlapping area between the openings 4 and 4 and the moving walls 5 and 5 to be regulated thereby controlling an opening degree of the valve as well as an amount of air supplied to to the internal combustion engine through the valve. It is to be noted here that the air supplied to the internal combustion engine flows into the movable section 2 from a position above the drawing sheet, passes through the valve formed between the openings 4 and 4 and the moving walls 5 and 5, flows through the flow passage between the outer peripheral surface of the cylindrical wall of the stationary section 1 and the inner peripheral surface of the throttle body 3, and flows toward a location downstream of the throttle body 3. The movable section 2 is arranged at, for example, the bottom of the cylindrical member of the stationary section 1 through sliding means such as a bearing or the like, whereby the driving operational force required for rotatively driving the movable section 2 is restrained small as far as possible.

Figure 23B:
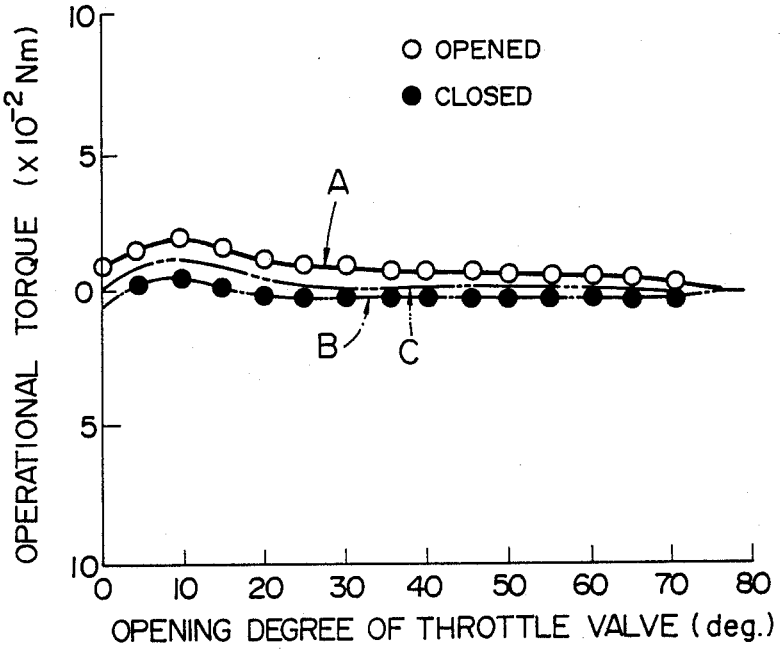

Experimental results of operational torque with respect to an opening degree of the coaxial rotary throttle valve constructed as above are indicated in FIG. 23B. In a graph illustrated in FIG. 23B, the solid line A dotted by white circle [o] represents operational torque in case where the valve is opened, a dot-and-chain line B dotted by black circle [•] represents operational torque in case where the valve is closed, and the two-dot-and-chain line C represents torque due to imbalance, that is, a mean value of the operational torque in case of opening of the valve and the operational torque in case of closing the valve. Specifically, in the coaxial rotary throttle valve, forces acting respectively upon the moving walls 5 and 5 of the movable section 2 by the suction air appear as represented by a distribution like a curve p in directions (indicated by arrows in the figure) perpendicular to the moving walls 5 and 5, as shown in FIG. 23A. The forces p acting upon the moving walls 5 and 5 are canceled out each other with respect to the center O of the valve, that is, the center of the movable section 2, so that the forces are fluidly balanced with each other. Thus, as shown in the graph of FIG. 23B, the torque due to imbalance as well as friction torque of the valve shaft is brought to an extremely low value. Accordingly, the operational torque required for controlling the throttle opening degree does not so much vary in the entire range of from 0 degree in the fully closed state to 80 degrees in the fully open state, so that the operational force equal to or less than $1\times10^{-2}$ Nm($\approx$1 kg·mm) suffices.

Figure 24A:
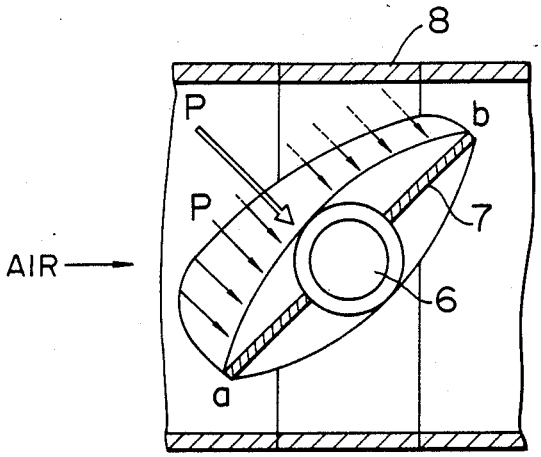
Figure 24B:
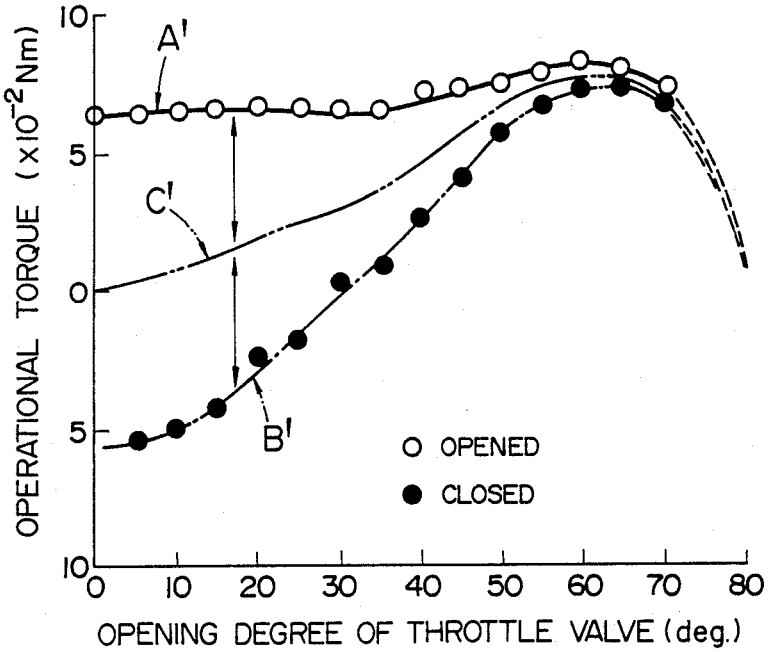

On the other hand, in the conventional throttle valve in the form of a butterfly valve as shown in FIG. 24A, the friction torque of the valve shaft 6 is brought to a high or large value in the range in which the throttle opening degree is small, and the requisite operational torque is brought to a relatively high value on the order to $6\times10^{-2}$ Nm($\approx$6 kg·mm) or $-6\times10^{-2}$ Nm, as represented by the characteristic graph shown in FIG. 24B. In this connection, also in FIG. 24B, similarly to FIG. 23B, a curve indicated by white circle [o] and the solid line A' represents operational torque in case of opening of the valve, a curve indicated by black circle [•] and the dot-and-chain line B' represents operational torque in case of closing of the valve, and the two-dot-and-chain line C' represents torque due to imbalance.

As will be apparent from these figures, the torque due to imbalance indicates a peak value in the vicinity of 60 degrees of the throttle opening degree. Accordingly, if an attempt is made to open the valve by means of a motor or the like, torque overcoming these two torques is required, and this makes it impossible to miniaturize the motor. That is, in the butterfly valve, as diagrammatically shown in FIG. 24A, as the valve 7 starts to open, a gap between a half peripheral portion of the valve 7 rotated on the outflow side and an inner surface of a suction pipe 8 forms a flow passage like a throttle nozzle in a flow pipe. If the cross-sectional area of the flow passage in the suction pipe 8 is reduced, the flow velocity is raised so that the static pressure is lowered. As shown in the figure, the flow velocity increases as a location approaches the outflow side end b from the inflow side end a of the valve 7, and the static pressure p is lowered correspondingly to the increase in the the energy amount of the flow velocity as indicated by the broken line in the figure. Composition of the static pressure p at various parts on the surface of the inclined valve 7 is brought to a force of action P in the figure. Since this force of action P is so exerted as to act inevitably upon the side upstream of the valve shaft 6 at the center of rotation of the valve 7, the force of action P serves as a rotative force in such a direction as to close the valve 7 centering around the valve shaft 6. In this case, further, vacuum is produced due to eddy current occurring on the side (back side) downstream of the valve 7, so that a force urging the valve 7 toward the flow direction is further added largely. Thus, the imbalance of this valve 7 of butterfly type is brought to an extremely large value. It is impossible from the viewpoint of the principles to reduce the imbalance.

As described above, the coaxial rotary throttle valve is capable of reducing the operational torque to an extremely small value, as compared with the conventional one of butterfly type. Thus, the electronically controlled type throttle valve for internal combustion engines, according to the invention, employs such coaxial rotary throttle valve, whereby the operational torque for the throttle opening degree is restrained low so that the driving force source of the valve is brought to a small capacity, in an attempt to miniaturize the overall dimension.

Figure 1:
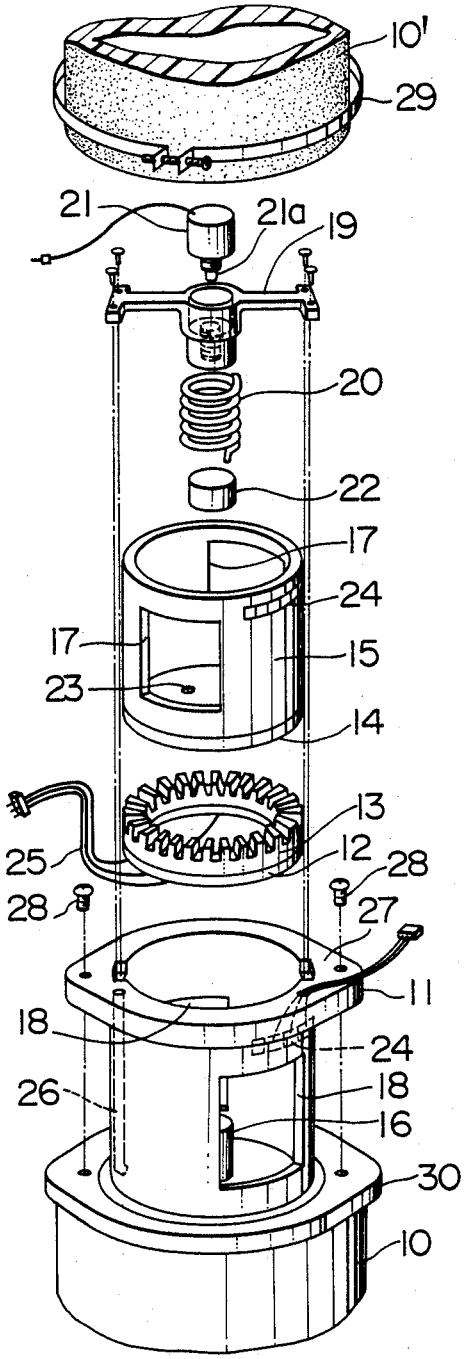
FIG. 1 is a developed perspective view of an electronically controlled type throttle valve for internal combustion engines, according to an embodiment of the invention.
Figure 2:
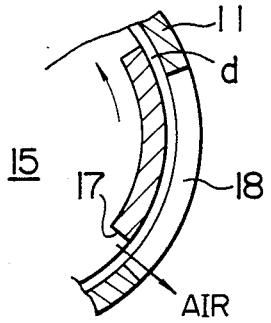
FIG. 2 is a cross-sectional view of the throttle valve, taken along the line II—II in FIG. 3.
Figure 3:
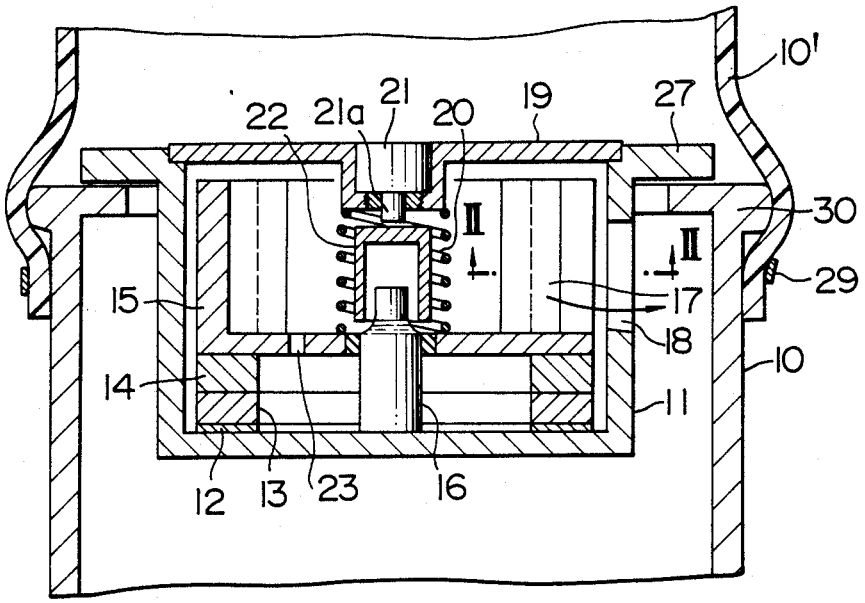
FIG. 3 is a longitudinal cross-sectional view of the throttle valve.

FIGS. 1 through 3 show an embodiment of the invention. FIG. 1 is an exploded perspective view, FIG. 2 is a fragmentary longitudinal cross-sectional view, and FIG. 3 is a cross-sectional side view. In these figures, the reference numeral 10 denotes a suction pipe for an internal combustion engine. A stationary section 11 serving as a base for valve mounting assembly is mounted to an end of the suction pipe 10 on the side of air inflow. The entire electronically controlled type throttle valve including an actuator is assembled to the stationary section 11.

The stationary section 11 serves to form a stationary section for the valve, and is composed of a generally cylindrical member provided with a bottom. A piezoelectric element 12, a vibrating element 13 and a moving element 14, which form an ultrasonic motor, are arranged at the bottom of the stationary section 11 and within the same. An ultrasonic vibrating motor is generally called the ultrasonic motor.

A movable section 15 of the valve is inserted in the stationary section 11 for angular movement about an axis of a fixed shaft 16 in such a manner that a center of the angular movement is restricted by the fixed shaft 16.

The movable section 15 has a generally cylindrical shape having a bottom, like the stationary section 11. The moving element 14 of the ultrasonic motor is mounted to the bottom of the movable section 15. Thus, the ultrasonic motor is relatively driven as an actuator.

The movable section 15 is formed with a pair of openings 17 and 17 arranged in symmetric relation to each other with reference to the axis of the fixed shaft 16. Likewise, the stationary section 11 is formed with a pair of openings 18 and 18 arranged in symmetric relation to each other with reference to the axis of the fixed shaft 16. When the movable section 15 moves angularly and takes a position where the openings 17 and 18 coincide with each other, the opening degree of the valve is brought to the maximum, while when the valve takes a position where the openings 17 are displaced completely from the openings 18, the valve is brought to a fully closed state. That is, as will particularly be clear from FIG. 3, suction air flowing from an upstream air cleaner through a flexible tube 10' enters the interior of the movable section 15 which opens upwardly as viewed in the figure, then passes through the openings 17 in the movable section 15 and the openings 18 in the stationary section 11, and flows to the outside of the stationary section 11, that is, to the interior of the suction pipe 1. Accordingly, if the movable section 15 is driven to move angularly by the aforesaid ultrasonic motor, the valve can operate as a throttle valve of rotary valve type driven by an electric actuator, in which control can be effected in such a manner that the suction-air flow passage is fully closed at the position where the openings 17 and 18 are displaced completely from each other, while the flow passage is fully opened at the position where the openings 17 and 18 overlap with each other sufficiently.

A support member 19 is mounted to an upper portion of the stationary section 11. A return spring 20 is arranged between a lower surface of a central projection of the support member 19 and an inner bottom surface of the movable section 15, so as to generate torsion stress. Thus, the arrangement is such that when the movable section 15 is in an angularly movable state, the movable section 15 is returned to the aforementioned fully closed position under the biasing force of the return spring 20.

The support member 19 is provided with an electromagnetic solenoid 21. When the electromagnetic solenoid 21 is excited, a movable member **21*a* of the solenoid 21 is pushed out downwardly. With such arrangement, the movable member 21*a* urges the movable section 15 downwardly through a cylindrical member 22, thereby urging the moving element 14 against the vibrating element 13** with a predetermined force.

In connection with the above, the reference numeral 23 in the figures denotes a ventilation bore serving to introduce the atmospheric pressure to a position below the movable section 15. The reference numeral 24 designates opening-degree detecting means such as, for example, an MR element serving to magnetically detect the angular position of the movable section 15. Further, the reference numeral 25 denotes a lead cable for the piezoelectric element 12 of the ultrasonic motor, and the reference numeral 26 designates a passage through which the lead cable 25 is led to the outside.

The stationary section 11 is formed at its upper end with a flange 27. When the throttle valve is assembled, the flange 27 is abutted against the end of the suction pipe 10, and the stationary section 11 is fixed to the suction pipe 10 by means of screws 12 and 12. The flexible tube 10' extending from the air cleaner extends to the end of the suction pipe 10, and the end of the suction pipe 10 is inserted in the flexible tube 10', as shown in FIG. 3. Subsequently, the flexible tube 10' is fixed to the end of the suction pipe 10 by, for example, a metallic band 29. The suction pipe 10 is formed at its end with an annular projection 30 for ensuring that the flexible tube 10' is fixed to the end of the suction pipe 10.

The operation of the embodiment constructed as above will next be described.

When multiphase alternating voltage having predetermined frequency is applied to the piezoelectric element 12 of the ultrasonic motor, vibration of a predetermined mode is generated at the vibrating element 13.

Simultaneously with the above, when the electromagnetic solenoid 21 is supplied with electric current, the moving element 14 is urged against the vibrating element 13 with a predetermined force. As a result, the moving section 15 is rotatively driven at a predetermined speed which is determined by the frequency of the above multiphase alternating voltage, whereby the moving section 15 serves as a throttle valve having the ultrasonic motor as the driving actuator. In this connection, the rotational direction at this time can optionally be determined by the order of the phases of the multiphase alternating voltage.

FIG. 2 shows a state in which the openings 17 in the movable section 15 are almost displaced from the openings 18 in the stationary section 11 so that the suction air passage is substantially in the closed position. As the movable section 15 is moved angularly from this state in the direction indicated by an arrow, the suction air passage is enlarged. When the openings 17 and 18 overlap with each other completely, the suction air passage is brought to a fully open state. Thus, it will be seen that a flow rate of the suction air can be controlled.

A case will be considered where after the movable section 15 has been rotatively driven to a position other than the fully closed position, the multiphase alternating current stops to be applied to the piezoelectric element 12 of the ultrasonic motor. Since, in this case, the moving element 14 is urged against the vibrating element 13 by the electromagnetic solenoid 21, friction force between them ensures that the movable section 15 is restrained at this position, against the restoring force of the return spring 20, so that a predetermined throttle opening degree is maintained.

A case will next be considered where supply of electric current to the electromagnetic solenoid 21 is suspended when the movable section 15 is in a position other than the fully closed position. In this case, the urging force acting upon the movable section 15 by the movable member **21*a* of the solenoid 21 is eliminated, so that the contact force between the moving element 14 and the piezoelectric vibrating element 13** is reduced.

As a result, the friction force between them is reduced considerably, so that the movable section 15 is made substantially free and is returned to the fully closed position under the action of the return spring 20.

Accordingly, when control with respect to the ultrasonic motor is lost for some reason during running of the engine, the movable section 15 is returned to the fully closed position under the return force of the return spring 20, if supply of current to the electromagnetic solenoid 21 is suspended. Thus, there is provided a fail-safe fuction which can ensure to restrain an anxiety such as reckless driving of an automotive vehicle, or the like.

It is desirable that a gap d (see FIG. 2) between the inner surface of the cylindrical portion of the stationary section 11 and the outer surface of the cylindrical portion of the movable section 15 is narrow from the viewpoint of the function as the valve. On the other hand, however the gap d cannot so much be narrowed from the viewpoint of prevention of sticking due to biting of the dust to secure smooth movement of the movable section 15. Thus, it is practical that the gap d is maintained to a value equal to or larger than 30 micrometers. In this connection, it is preferable to prevent biting of the dust by coating of solid lubricant such as, for example, molybdenum disulfide or the like. In this case, it can also be expected that ultrasonic vibration from the piezoelectric element 12 of the ultrasonic motor is transmitted to the movable section 15 thereby removing the dust.

By the way, if water is accumulated at the bottom of the stationary section 11, there may be a case where the water is frozen to make the operation impossible. In practice, accordingly, it is preferably that the arrangement is used such that the fixed shaft 16 approaches the horizontal. In this connection, if the ultrasonic motor is operated when the movable section 15 and the stationary section 11 stick to each other due to freezing of water or the like, excessive force is applied to the vibrating element 13 from the piezoelectric element 13 to expedite wear of the vibrating element 13 and the moving element 14. In this case, therefore, the frequency of the polyphase alternating voltage supplied to the ultrasonic motor should be so lowered as to cause the movable section 15 to be angularly moved slowly.

Figure 4:
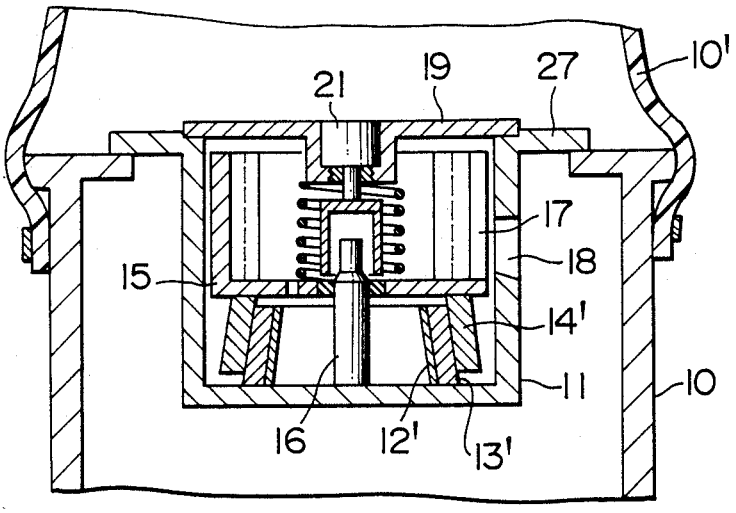
FIG. 4 is a cross-sectional view showing another embodiment.

FIG. 4 shows another embodiment of the invention, which utilizes an annular ultrasonic motor of expansion vibration type as an actuator for driving a throttle valve. The reference numerals 12', 13' and 14' in the figure denote a piezoelectric element, a vibrating element and a moving element, respectively, each of which is in the form of a conical annulus.

Since, in this embodiment, each of the vibrating element 13' and the moving element 14' is in the form of a conical annulus, there is provided sufficient friction force between the vibrating element 13' and the moving element 14', even if the urging force due to the electromagnetic solenoid 21 is not so much large.

The embodiment illustrated in FIG. 1, particularly the fail-safe function thereof will next be described in further detail with reference to FIGS. 5A and 5B.

The electromagnetic solenoid 21 is mounted to the support member 19 arranged above the stationary section 11 by means of screw connection. By this electromagnetic solenoid 21 as well as the return spring 20, there is obtained the fail-safe function as described previously. FIG. 5A shows a state in which control by the ultrasonic motor is effected without abnormality. At this time, electric current is supplied to the electromagnetic solenoid 21. Thus, the movable member **21*a* is pushed out so that the moving element 14 in a united relation to the movable section 15 is urged against the vibrating element 13 with a predetermined contact force through the cylindrical member 22**.

In this state, accordingly, if polyphase alternating voltage of a predetermined frequency is applied to the piezoelectric element 12, there is obtained an action or motion as an annular ultrasonic motor, so that the movable section 15 can be moved angularly in the optional direction centering around the fixed shaft 16. Thus, as described previously, it is possible to control the throttle opening degree by varying the overlapping condition between the openings 17 in the movable section 15 and the openings 18 in the stationary section 11.

Figure 5A:
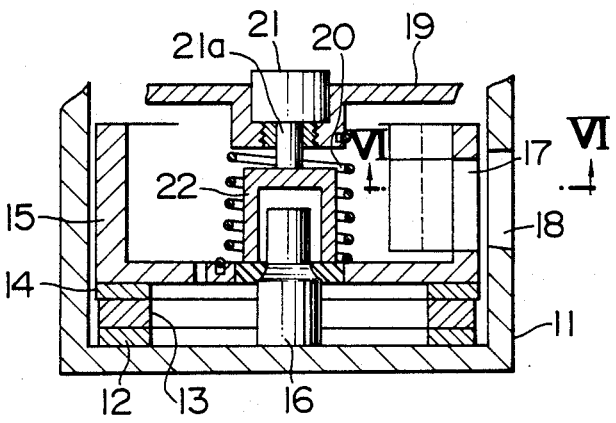
FIGS. 5A and 5B are longitudinal cross-sectional views for explanation of the operation of the embodiment illustrated in FIGS. 1 and 3.
Figure 5B:
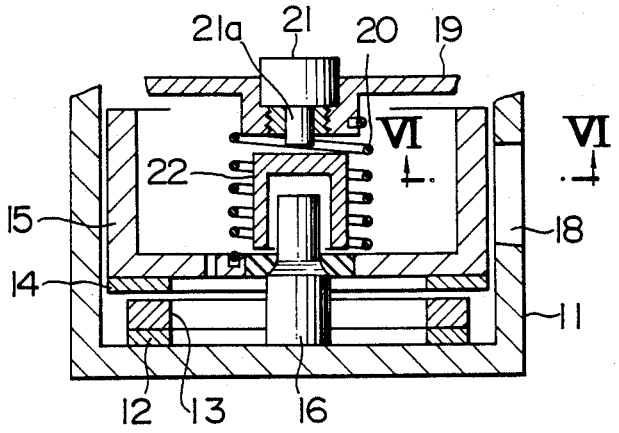

On the other hand, FIG. 5B shows a state in which an abnormality occurs in the control of the ultrasonic motor, that is, a state in which the fail-safe function comes into play. In this state, supply of electric current to the electromagnetic solenoid 21 is interrupted. As a result, the urging force acting upon the cylindrical member 22 by the movable member **21*a* of the electromagnetic solenoid 21 disappears and, further, the urging force acting upon the vibrating element 13 by the moving element 14 of the movable section 15 also disappears. Accordingly, the moving element 14 of the movable section 15 is separated away from the vibrating element 13 under the biasing force of the return spring 20, so that the movable section 15 is brought to an angularly movable state. As a result, the return force toward the valve fully closed position under the biasing force of the spring 20 operates so that the movable section 15** is returned to the fully closed position automatically. Thus, the return force acts to prevent the throttle valve from being maintained opened. That is, the fail-safe function is given to the throttle valve.

Figure 6A:
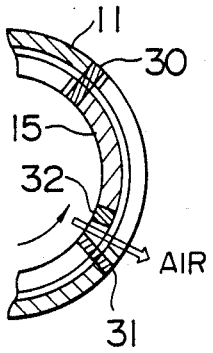
FIGS. 6A through 6C are enlarged fragmentary cross-sectional views taken along the line VI—VI in FIGS. 5A and 5A, for explanation of the operation of the valve.
Figure 6B:
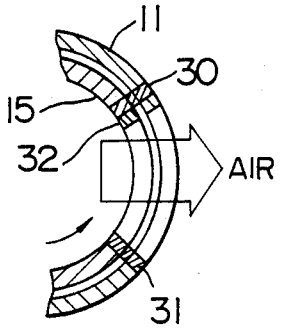
Figure 6C:
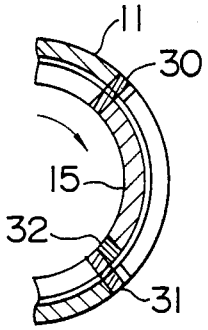

FIGS. 6A through 6C are cross-sectional views taken along the line VI—VI in FIGS. 5A and 5B. FIG. 6A shows a state of a low opening-degree range at the normal operation, while FIG. 6B shows a state of a fully open-degree range at the normal operation. The reference numeral 30 denotes a fully open stopper, and the reference numeral 31 denotes a fully closed stopper. A lever 32 of the movable section 15 is so arranged as to be moved between the fully open stopper 30 and the fully closed stopper 31. FIG. 6C shows a fail-safe state at the time the control is made impossible due to a malfunction of the ultrasonic motor, or the like.

The operational principals of the annular ultrasonic motor will next be described with reference to FIG. 7.

Figure 7:
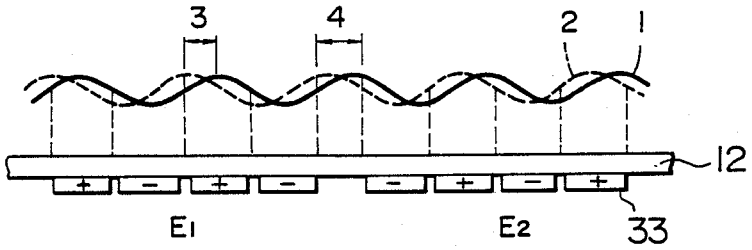
FIG. 7 is a view for explanation of the operation of a ultrasonic motor serving as driving means for the valve.

In a developed view of FIG. 7, the reference numeral 33 denotes electrodes which are mounted to the piezoelectric element 12. When voltages $E_1$ and $E_2$ having their respective predetermined phases are applied to the electrodes 33 as predetermined groups, a variation distribution of a progressive wave due to the voltage $E_1$ is brought to one indicated by ①, while a variation distribution of a progressive wave due to the voltage $E_2$ is brought to one indicated by ②. The minimum displacement of these progressive waves is brought to one indicated by ③ in the figure. Thus, it is possible to provide requisite resolving power by varying the distance indicated by ④.

In the embodiments mentioned above, the configuration of the openings 17 formed in the movable section 15 have been described as being rectangular or square like that of the opening 18 in the stationary section 11.

Figure 8:
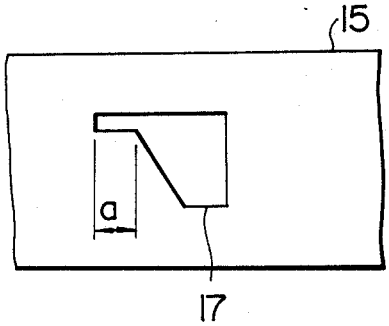
FIG. 8 is an enlarged fragmentary view showing an example of an opening in the valve.

It is to be noted, however, that the openings are not limited to this specific configuration, but can have another configuration. Another embodiment of the openings 17 formed in the movable section 15 is shown in FIG. 8. Various configurations can be considered as the configuration of the openings 17, whereby there is provided a diversification in the content of the control of the suction air flow rate. By provision of a portion indicated by a, the embodiment illustrated in FIG. 8 aims at obtaining high resolution power in a range (on the left-hand side in the figure) in which the throttle opening degree is low.

Figure 9A:
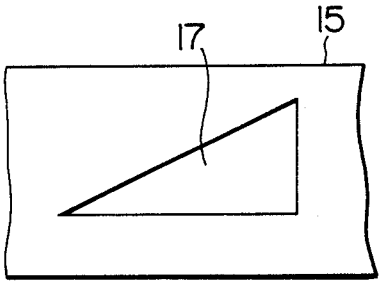
FIGS. 9A and 9B are views showing a modification of the valve opening illustrated in FIG. 8.
Figure 9B:
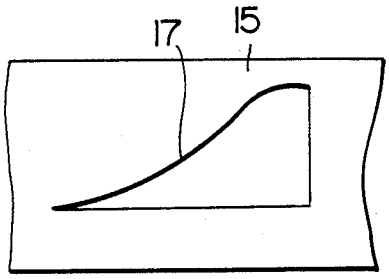

FIGS. 9A and 9B are also developed side elevational views of the movable section 15. As shown in these figures, the arrangement of the triangular opening 17 is such that the acute angle is narrowed toward the low opening degree (to the left as viewed in the figures), whereby the opening area of the opening 17 varies itself continuously. With such arrangement, there is provided such an advantage that, even if the control accuracy of the motor serving as a source of operation driving force for the valve is coarse, the control accuracy of the air flow rate flowing can be secured sufficiently.

Figure 10:
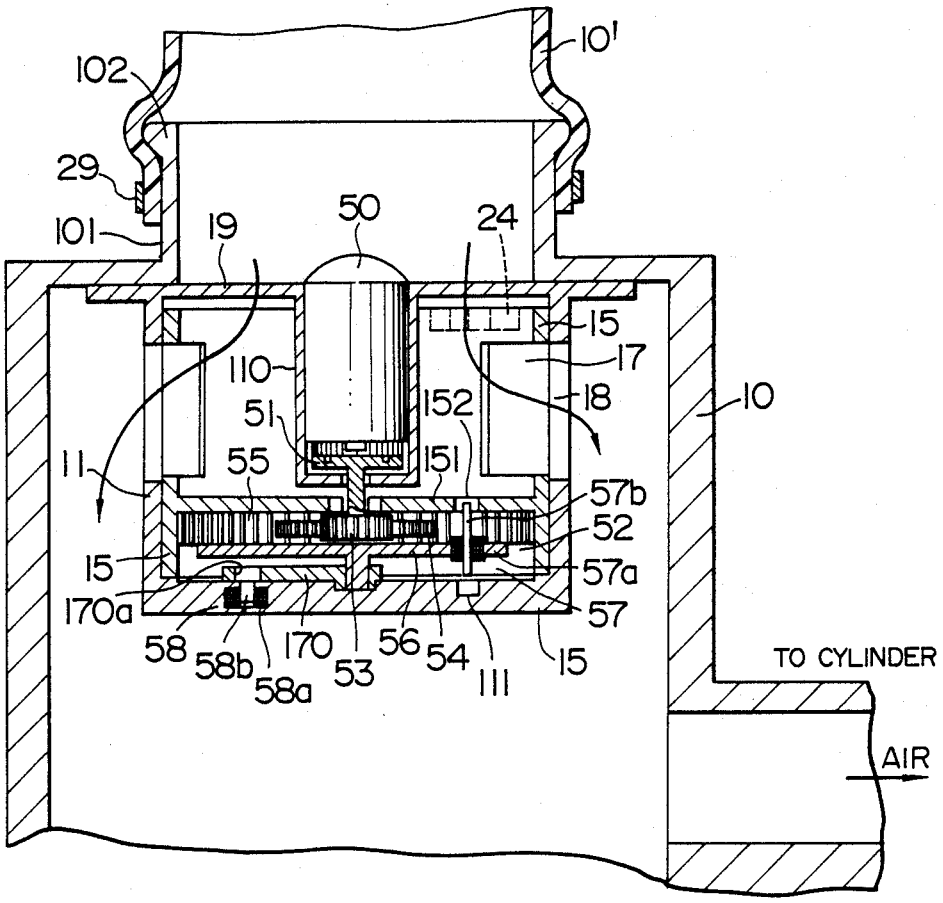
FIG. 10 is a longitudinal cross-sectional view of an electronically controlled type throttle valve for internal combustion engine, according to another embodiment of the invention.

FIGS. 10 through 12 show another embodiment of the electrically controlled type throttle valve for internal combustion engines, according to the invention. The embodiment employs a DC motor and a planetary gear mechanism, in place of the ultrasonic motor serving as the driving operation source for driving the movable section of the throttle valve illustrated in FIG. 1. In FIGS. 10 through 12, components and parts like or similar to those shown in FIG. 1 are designated by the same reference numerals. In FIG. 10, the reference numeral 10 denotes a throttle chamber. A tubular projection 101 extends from an upper end of the throttle chamber 10. The tubular projection 101 is formed at its forward end with an annular projection 102 which is inserted in the flexible tube 10' connected to the air cleaner. In this manner, the flexible tube 10' is fixed to the annular projection 102. In this embodiment, the throttle valve is mounted to a shoulder of the throttle chamber 10, and suction air passes as indicated by an arrow and is fed into cylinders of the engine through an outlet on the right-hand side as viewed in the figure.

A cylindrical motor accommodating portion 110 is formed at a center of the support member 19 provided at the upper portion of the stationary section 11. The above-mentioned DC motor 50 is incorporated in the accommodating portion 110. As will be clear from the figure, the support member 19 is formed in integral relation to the stationary section 11. The motor accommodating portion 110 is arranged in the interior space of each of the cylindrical stationary section 11 and the movable section 15 in concentric relation thereto. The motor accommodating portion 110 is in the form of a cylinder having a diameter smaller than the inner diameter of the cylindrical movable section 15. The DC motor 50 is inserted vertically in the cylindrical interior of the motor accommodating portion 110 and is fixedly mounted thereto. Further, a reducing gear mechanism 51 is arranged below the DC motor 50.

An appropriate number of openings (air flow bores) 18 are formed in the side face or the side wall of the stationary section 11, similarly to the embodiment illustrated in FIG. 1. The side face of the movable section 15 is also provided with an appropriate number of openings 17. In this embodiment, the interior space of the cylindrical movable section 15 is arranged on the side of the atmosphere on the upstream side with reference to the suction air flow, on the basis of the stationary section 11.

The movable section 15 is in the form of a cylinder having a diameter slightly smaller than the inner diameter of the stationary section 11. The movable section 15 is accommodated in the stationary section 11 for sliding movement relative thereto, so that the movable section 15 rotates along the inner peripheral surface of the stationary section 11. Similarly to the embodiment illustrated in FIG. 1, the movable section 15 is formed with the openings 17 correspondingly respectively to the openings (valve bores) 18 in teh stationary section 11. Further, the movable section 15 serving as a rotary valve body has the interior which is divided, by a partition wall 151, into an upper space and a lower space arranged along the rotary axis. The upper space serves as a flow passage for the suction air, and the DC motor 50 is located at the center of the upper space. On the other hand, the divided lower space has accommodated therein a driving-torque switching mechanism 52 which is driven by the DC motor 50 and the reducing gear mechanism 51. That is, the driving-torque switching mechanism 52 is arranged between the partition wall 151 of the movable section 15 and the bottom surface of the cylindrical stationary section 11.

Figure 11A:
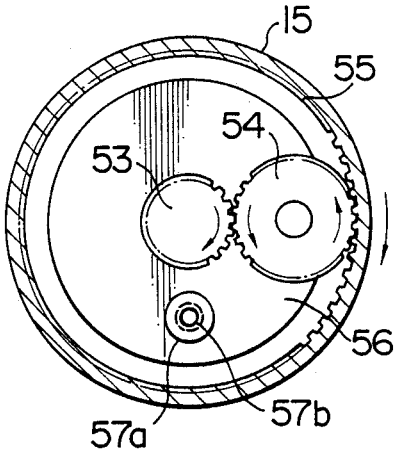
FIGS. 11A and 11B are cross-sectional views of a driving-torque switching mechanism illustrated in FIG. 10.
Figure 11B:
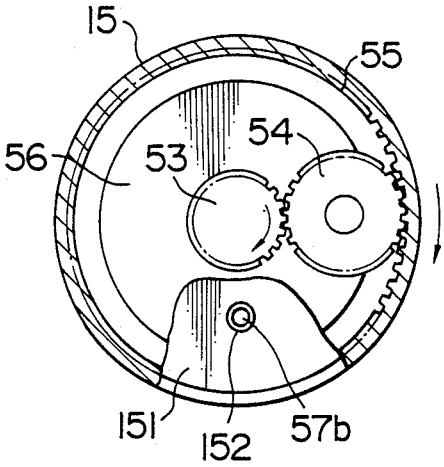

The arrangement of the driving-torque switching mechanism 52 will be described with reference to FIGS. 11A and 11B. FIGS. 11A and 11B are top plan views of the driving-torque switching mechanism 52 which is composed of a sun gear 53, planet gears 54, internal gear 55, a planet-gear fixing table 56, and a plunger (pin) mechanism 57.

The sun gear 53 is connected to an output shaft of the DC motor 50 through the reducing gear mechanism 51. On the other hand, the internal gear 55 is formed on the inner periphery of the movable section 15 serving as a rotary valve body. The planet gears 54 are arranged between the internal gear 55 and the sun gear 53. The plunger mechanism 57 is composed of a solenoid **57*a* and a plunger 57*b*. Setting is made in such a manner that if the solenoid 57*a* is in an OFF state when the movable section 15 is in an initial (closed) position, the plunger 57*b* is engaged with a bore 152 formed in the partition wall 151 of the movable section 15, while when the solenoid 57*a* is in an ON state, the plunger 57*b* is engaged with a bore 111 formed in an inner surface of one end of the stationary section 11**.

Figure 12A:
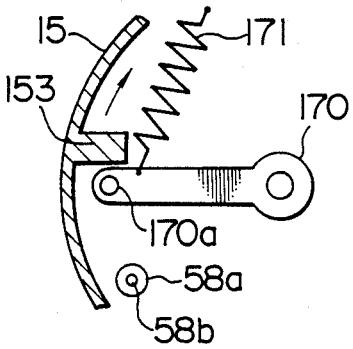
FIGS. 12A and 12B are views for explanation of the operation of a fail-safe lever illustrated in FIG. 10.
Figure 12B:
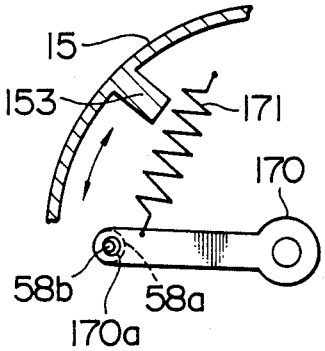

The reference numeral 170 in FIGS. 12A and 12B denotes a fail-safe lever whose one end is formed therein with a bore **170*a*. The fail-safe lever 170 is arranged on the inside of the bottom surface of the stationary section 11. Normally, a solenoid 58*a* of a plunger mechanism 58 is turned on to bring a plunger 58*b* into engagement with the bore 170*a*, so that the fail-safe lever 170 is locked. The state at this time is illustrated in FIG. 12B, in which the lock position of the lever 170 is set to one which does not interfere with the rotating motion of the movable section 15. On the other hand, at uncontrolled running of the engine, that is, abnormally, the solenoid 58*a* is turned off so that the plunger 58*b* is disengaged from the bore 170*a*. The state at this time is illustrated in FIG. 12A, in which the lever 170 is engaged with an abutment 153 on the movable section 15 under the biasing force of the return spring 171, to forcibly rotate the movable section 15** to the fully closed position.

The operation of the above embodiment will next be described. Prior to the start-up of the engine, for example, the solenoid 58a is first turned on so that the plunger 58b is disengaged from the bore 152 in the partition wall 151 of the movable section 15, but is engaged with the other bore 111 in the stationary section 11. In this state, a so-called large torque system is formed, in which the driving torque is transmitted to the sun gear 53 through the DC motor 50 and the reducing gear mechanism 51 and, subsequently, is transmitted to the movable section 15 through the planet gears 54 and the internal gear 55. In this state, if the DC motor 50 is rotated in the normal direction, i.e., in the valve-operating direction, the power is transmitted to the sun gear 53, the planet gears 54 and the internal gear 55 in order, as shown in FIG. 11A. Thus, the power is reduced considerably by the planet gears 54 so that the movable section 15 is rotated at low speed and with a large driving torque.

Then, the other solenoid 58a is turned on to bring the plunger 58b into engagement with the bore 170a in the fail-safe lever 170, thereby fixing or locking the lever 170. The plunger 57b is engaged with the bore 152 on the side of the stationary section 11, so that the transmission system of the driving torque is constituted which extends from the sun gear 53 to the movable section 15 through the planet-gear fixing table 56, the plunger 57b and the bore 152. That is, in this case, the planet gears 54 do not serve as a transmitting element, so that the torque system is switched to the normal driving-torque system in which the driving torque is relatively small.

Moreover, if the engine rotational speed rises abnormally during the running, the solenoid 58a is turned off to disengage the plunger 58b from the lever bore 170a, so that the lever 170 returns the movable section 15 to the fully closed position shown in FIG. 12A under the biasing force of the spring 171.

According to the embodiment constructed as abvoe, the tubular stationary section 11 and the movable section 15 are accommodated in the suction passage 10, whereby the motor 50 serving as a driving source can also be so accommodated as to face toward the flow direction within the suction passage 10 without any hindrance. Thus, the motor 50, the reducing gear mechanism 51, the driving-torque switching mechanism 52 and so on can be mounted without attaching to the outer wall of the throttle chamber 10, similarly to the motor 50. Furthermore, the motor 50, the stationary section 11, the movable section 15, the reducing gear mechanism 51, the driving-torque switching mechanism 52 and so on can be reduced in attaching space of the components and, therefore, can be accommodated and arranged within the suction passage 10 without the necessity of enlarging the suction passage 10. As a result, it is possible to miniaturize the entire throttle chamber 10.

In the embodiment, by the use of the driving-torque switching mechanism 52, the movable section 15 is rotatively driven beforehand within the stationary section 11 at low speed and with force large in driving torque, prior to the start-up of the engine. By such operation, should the dust adhere to the interface between the movable section 15 and the stationary section 11, the dust would be removed by the forcible rotation, thereby making it possible to effectively prevent sticking.

Figure 13:
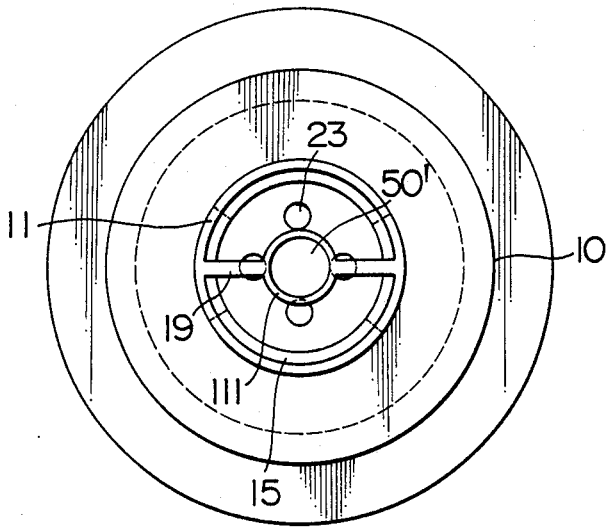
FIGS. 13 and 14 are a top plan view and a cross-sectional view, respectively, showing still another embodiment of the invention.
Figure 14:
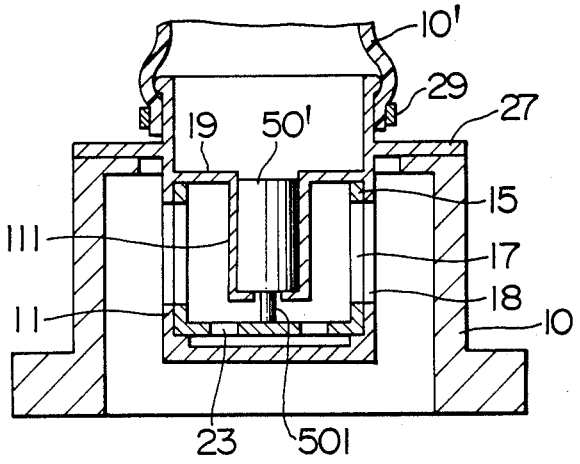

FIGS. 13 and 14 shows still another embodiment. In this embodiment, a brush-less DC motor 50' is employed as a driving source. Further, the embodiment is provided with no driving-torque switching mechanism like one illustrated in FIG. 10. Thus, the embodiment has its construction which is relatively simple and practical. FIG. 13 is a top plan view of this embodiment, and FIG. 14 is a longitudinal cross-sectional view of the embodiment.

The embodiment utilizes the brush-less DC motor 50' as a driving source for the movable section 15. The motor 50' has an output rotary shaft 501 which is connected directly to the bottom surface of the movable section 15 to directly drive the same. The interior space of the tubular stationary section 11 in this embodiment faces toward the atmospheric pressure side, that is, the upstream side of the suction passage 10 on the basis of the stationary section 11 per se. An atmospheric pressure bore 23 is formed in the bottom of the movable section 15 which is accommodated in the interior space of the stationary section 11. By existence of the atmospheric pressure bore 23, the pressure on the inside of the bottom of the movable section 15 and the pressure on the outside of the bottom of the same are made equal to each other, making it possible to reduce the driving torque required for driving operation of the movable section 15.

Figure 15:
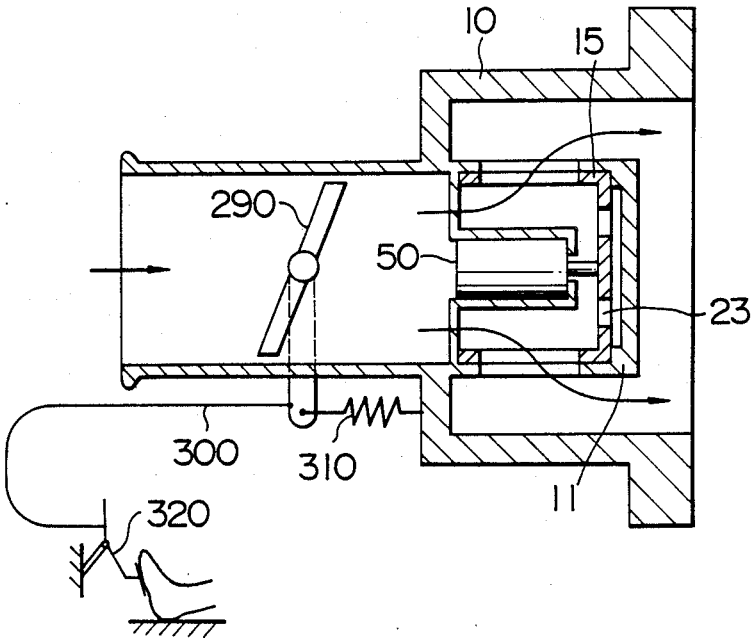
FIG. 15 is a cross-sectional view of a two-stage throttle mechanism in which the electronically controlled type throttle valve for internal combustion engines, according to the invention, is combined with the conventional butterfly valve.

FIG. 15 shows another embodiment in which the throttle body 10 of the throttle valve illustrated in FIGS. 13 and 14 is extended upwardly or to the left as viewed in the figure, and a conventional butterfly valve 290 is arranged within the extended portion. That is, the embodiment illustrated in FIG. 15 has a two-stage throttle mechanism in which the conventional mechanical throttle valve 290 and the electronically controlled type throttle valve according to the invention are combined with each other. The reason why the two-stage throttle construction is employed is as follows. That is, it may be considered that slight air leakage occurs between the movable section 15 and the stationary section 11, which constitute the electronically controlled type throttle valve. By this reason, the conventional butterfly valve 290 is arranged in front of or upstream of the electronically controlled type throttle valve, in order to improve the throttle controllability. In the figure, the reference numeral 300 denotes an accelerator wire, and the reference numeral 310 denotes a return spring. The butterfly valve 290 is controlled in its opening degree, in accordance with an amount of depression of an accelerator pedal 320, by a throttle mechanism which is composed of the accelerator wire 300, and return spring 310 and so on.

Also in case where the mechanical and electronically controlled type throttle valves are arranged in two stages as is in this embodiment, the movable section 15 serving as a rotary valve body of the electronically controlled type throttle valve is finely or minutely adjusted in opening degree in response to a electronic control command on the basis of the engine running condition, in addition to the condition of the accelerator pedal 320. Thus, it is possible to control the engine with high accuracy. Further, the embodiment employs the electronically controlled type throttle valve illustrated in FIGS. 13 and 14. It will be apparent, however, the embodiment can utilize the electronically controlled type throttle valve illustrated in FIG. 1 or FIG. 10.

FIGS. 16A and 16B and FIGS. 17A and 17B show still another embodiments of the invention, respectively. The fundamental construction of a throttle valve according to these embodiments is illustrated in FIGS.

Figure 16A:
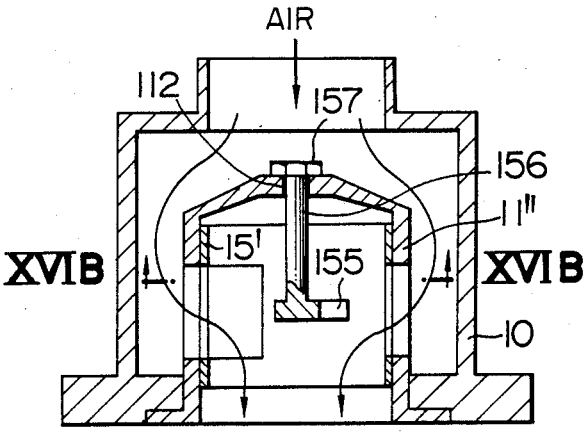
FIGS. 16A and 16B are longitudinal and transverse cross-sectional views of another embodiment of a valve mechanism for an internal combustion engine, according to the invention, FIG. 16B being the cross-sectional view taken along the line XVIB—XVIB in FIG. 16A.
Figure 16B:
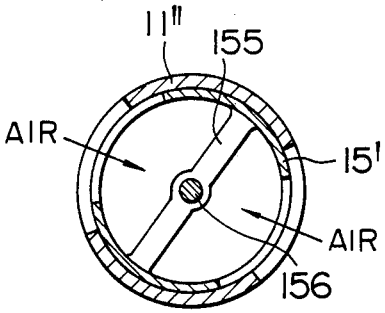

16A and 16B. Unlike the constructions described previously, the embodiment has such a construction that an interior space of a stationary section 11'' serving as a tubular valve seat faces toward the negative pressure side of the suction passage, and a movable section 15' serving as a rotary valve body is accommodated in the interior space of the negative pressure. The stationary section 11'' formed by a cylindrical member is fixedly mounted within the throttle body 10 in such a manner that an open end of the stationary section 11'' is located below and a bottom surface of the stationary section 11'' is located above. The movable section 15' is also formed by a cylindrical member, but a rod-like support portion 155 is so formed as to extend diametrically of the movable section 15'. The support portion 155 is provided at its center with a rotary shaft portion 156 extending vertically upwardly as viewed in the figure. The rotary shaft portion 156 of the cylindrical movable section 15' is inserted in a bore 112 provided at the center of the bottom of the stationary section 11'', and a screw 157 or the like is threadedly engaged with the forward end of the rotary shaft portion 156. Thus, the movable section 15' is supported rotatably within the stationary section 11''. Since the support structure of the embodiment is particularly such that the movable section 15' is suspended from the bottom of the stationary section 11'', the contact area between the movable section 15' and the stationary section 11'' is reduced. Thus, the support structure has such an advantage that the contact area can be minimized by interposition of a ball bearing or the like at the contact surface. Further, as indicated by arrows in the figure, suction air supplied from a location upstream of the throttle body 10 first passes through a space defined between the throttle body 10 and the outer periphery of the stationary section 11'', enters the interior space of the movable section 15' through the valve bores and, subsequently, is introduced into each cylinder of the engine through a location downstream of the throttle body 10. Since force toward the rotary center axis of the movable section 15' is exerted upon the wall surface of the movable section 15' which forms a valve, it is easy to take a balance of the movable section 15', as compared with the construction of each of the previously described embodiments in which force toward the outside is applied to the wall surface of the movable section. This has been ascertained also by experiments conducted by the inventors of this application. Furthermore, since, in the previously described embodiments, force toward the outside is applied to the cylindrical wall surface of the movable section 15 under the action of the inflow air, the wall surface expands outwardly. Therefore, there arises such a problem that the gap between the movable section 15 and the stationary section 11 is reduced so that the contact resistance increases, whereby the movable section 15 becomes immovable as the case may be. In order to overcome this problem, the wall of the movable section 15 is required to be increased in thickness. This, however, results in an increase in the weight of the movable section 15. In contradistinction to the previously described embodiments, the arrangement of the embodiment illustrated in FIGS. 16A and 16B is such that the force due to the inflow air acts inwardly. With such arrangement, the above-discussed problem can be eliminated, and the wall of the movable section 15 can be reduced in thickness, making it possible to reduce the overall weight.

Figure 17A:
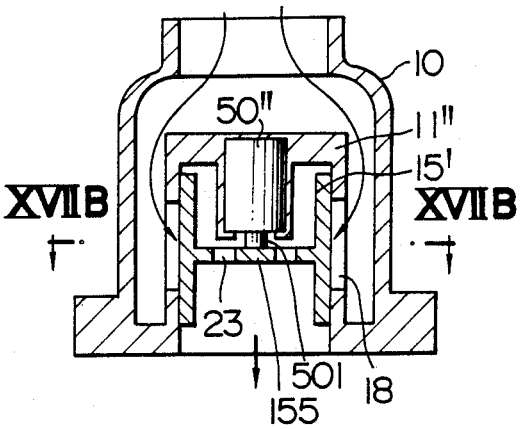
FIGS. 17A and 17B are likewise longitudinal and transverse cross-sectional views of still another embodiment, FIG. 17B being the cross-sectional view taken along the line XVIIB—XVIIB in FIG. 17A.
Figure 17B:
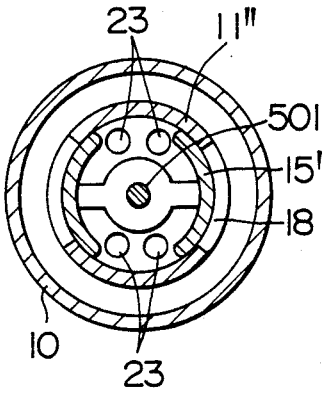

The embodiment illustrated in FIGS. 17A and 17B utilizes the construction shown in FIGS. 16A and 16B. Further, in this embodiment, a pulse motor or a stepping motor 50'' serving as a driving source is fixedly mounted to the bottom surface of the stationary section 11''. As will be clear from the figure, the motor 50'' has an output rotary shaft 501 which is mounted directly to the support portion 155 of the movable section 15'. According to this embodiment, the movable section 15' is of type in which it rotates on the side of the negative pressure. Thus, the operational torque due to imbalance acting upon the movable section 15' is brought substantially to zero. Further, the thickness of the hydraulic-pressure receiving surface of the air takeout port 18 becomes unconnected with the operational torque.

Figure 18:
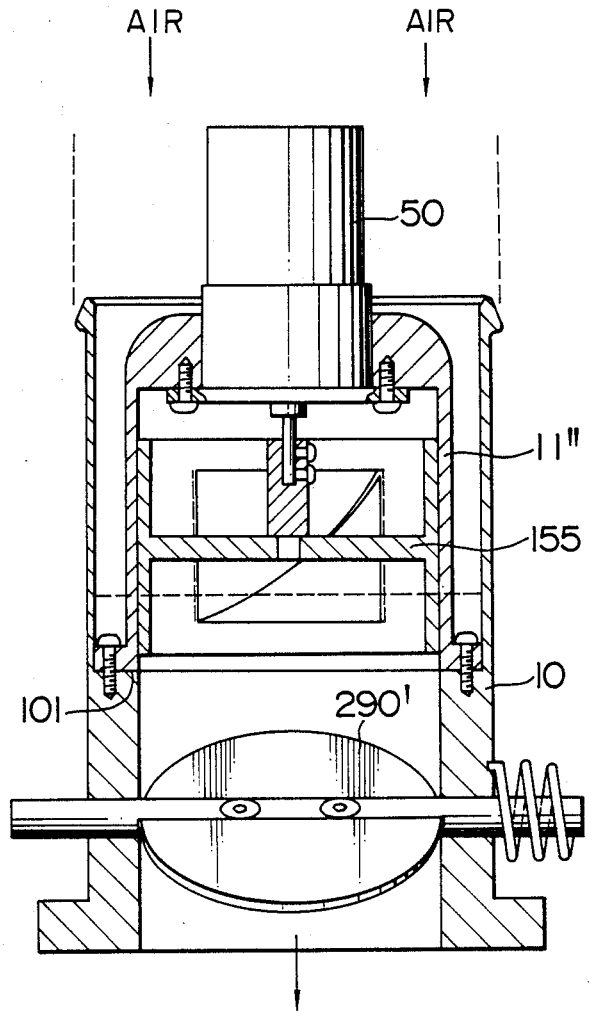
FIG. 18 is a cross-sectional view of another embodiment of a two-stage throttle mechanism.

FIG. 18 shows another embodiment which comprises its construction composed of a combination of the throttle valve construction shown in FIGS. 16A and 16B and FIGS. 17A and 17B and a conventional butterfly valve 290'. In FIG. 18, the throttle body 10 has its upper portion which is enlarged in inner diameter. The stationary section 11'' is fixedly mounted to a step 101 formed within the throttle body 10. The stationary section 11'' has a bottom surface to which the driving motor 50 is mounted. The bottom of the stationary section 11'' has an outer periphery which is formed into a spherical shape so as not to dissipate flow of inflow air as far as possible. Further, in this embodiment, the butterfly valve 290' is arranged downstream of the electronically controlled type throttle valve according to the invention.

Figure 19:
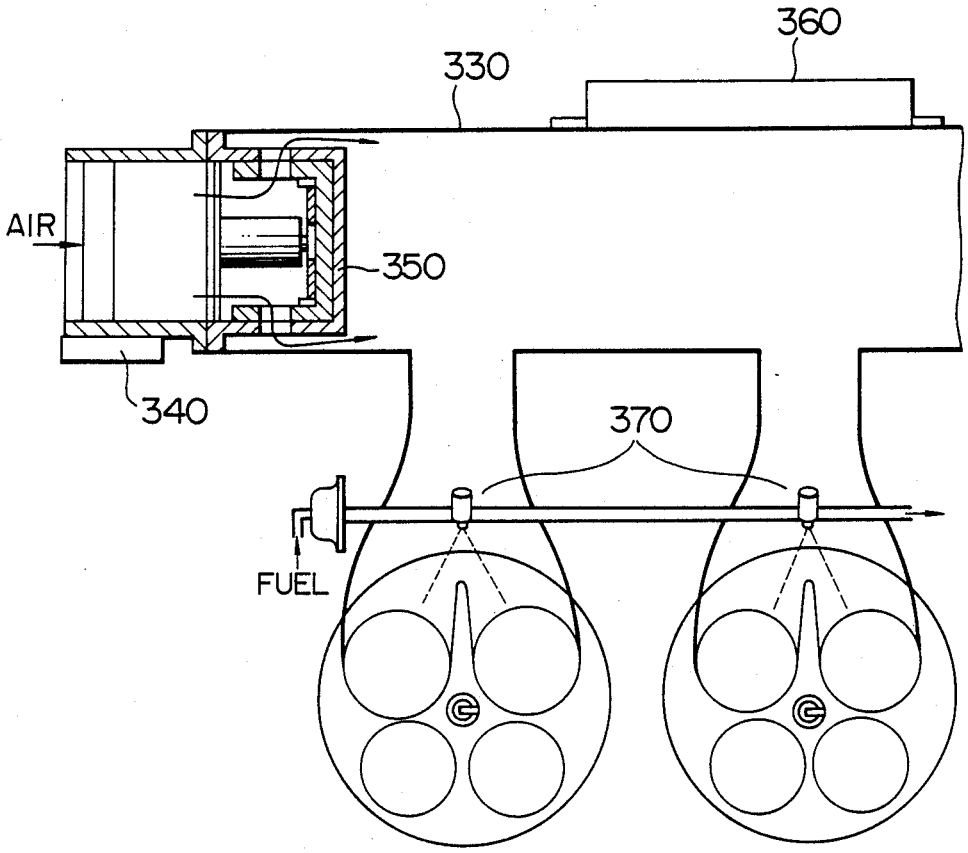
FIGS. 19 through 21 are views for explanation of various mounting conditions of the electronically controlled type throttle valve for internal combustion engines, according to the invention.
Figure 20:
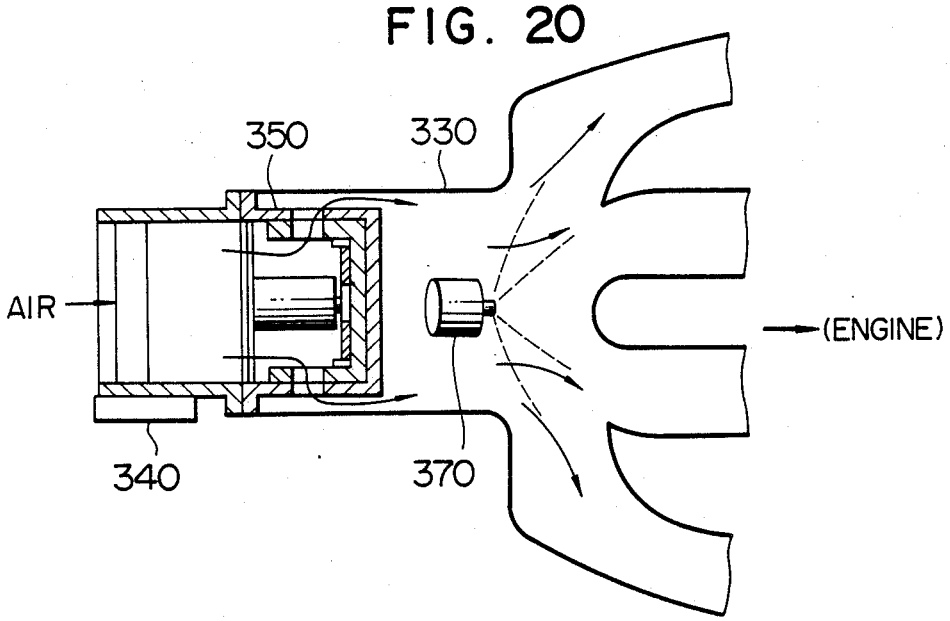
Figure 21:
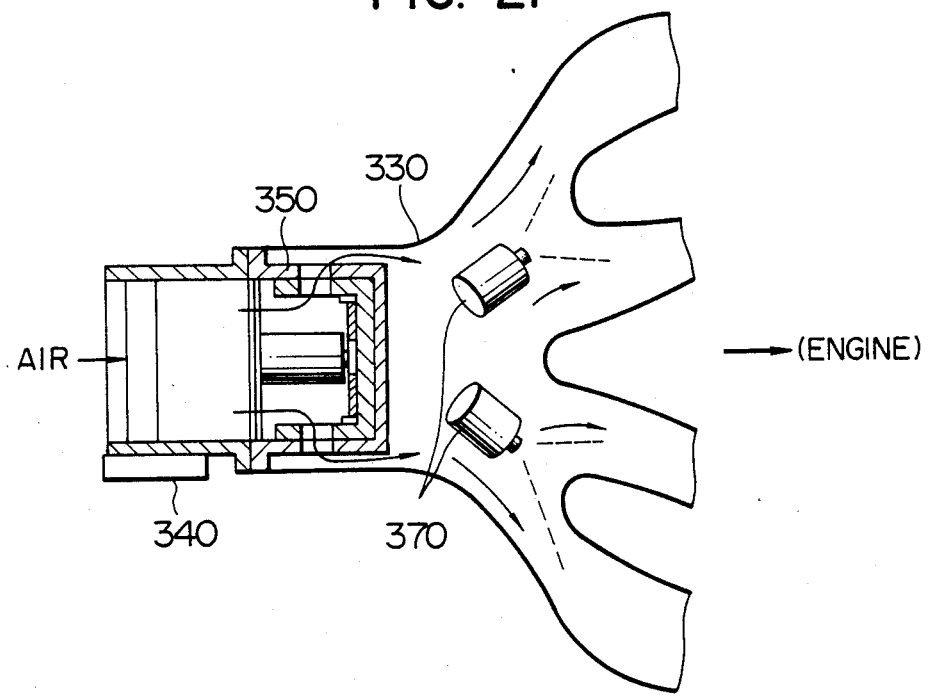

FIGS. 19 through 21 show, respectively, embodiments of an arrangement for mounting the electronically controlled type throttle valve according to the invention, to the internal combustion engine.

In the embodiment illustrated in FIG. 19, an air flow meter 340, the electronically controlled type throttle valve 350 according to the invention, and a control unit 360 are mounted to a collector 330 of a suction system of the engine. These components are combined with an injector 370 of M.P.I. (multi-port injection) type, to control air and fuel drawn into the engine, thereby controlling the engine output.

The embodiment illustrated in FIG. 20 comprises a combination of the electronically controlled type throttle valve according to any one of the previously described embodiments and an internal combustion engine of downstream S.P.I. (single-point injection) type. The fuel coming from the S.P.I. injector 370 is diffused by air flowing from the electronically controlled throttle valve 350, so that mixture of the fuel and the air is drawn into the engine.

The embodiment illustrated in FIG. 21 comprises a combination of the electronically controlled type throttle valve according to any one of the previously described embodiments and a twin S.P.I. type internal combustion engine. The embodiment has a pair of S.P.I. injectors 370. Since the air flow from the electronically controlled type throttle valve 350 is brought to a symmetric configuration, distribution of the mixture to the engine is improved.

Further, since the embodiment illustrated in any one of FIGS. 19 through 21 can be mounted directly to an inlet of the collector (surge tank) 330 of the engine, no space is required for mounting the throttle valve. The embodiment is particularly suitable as a countermeasure of such a recent tendency as to reduce the engine room. Moreover, since, in this case, the throttle chamber is brought to a position adjacent the engine, there is obtained a suitable result in the control response ability of the engine.

Figure 22A:
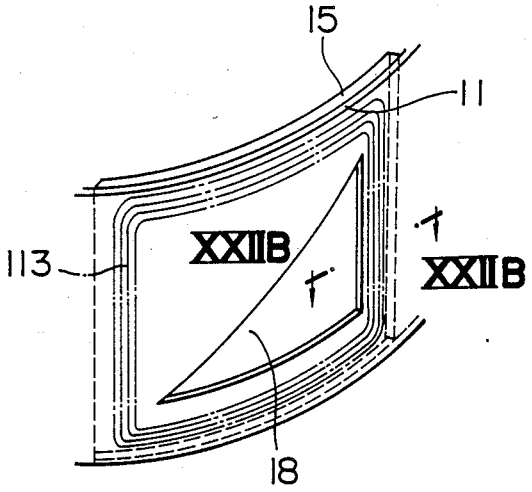
FIGS. 22A and 22B are a perspective view and a fragmentary cross-sectional view for explanation of an improvement in the valve opening.
Figure 22B:
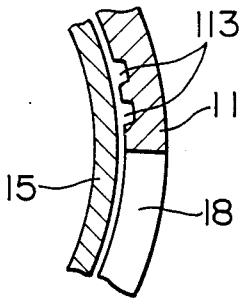

FIGS. 22A and 23A shows a seal arrangement between the stationary section 11 and the movable section 15 in the aforementioned throttle valve according to the invention. As described previously, it is preferable that the gap between the stationary section 11 and the movable section 15 of the throttle valve, which are cylindrical in shape, is maintained to a value on the order of 30 micrometers, in order to secure smooth rotation of the movable section 15. In this connection, the seal arrangement is required to secure high gas-tightness between the stationary section 11 and the movable section 15. As an example, as shown in the figures, triangular openings 18 are provided in the peripheral wall surface of the stationary section 11. It is of course that the openings 18 may be rectangular in shape. A so-called labyrinth is formed on the surface of the stationary section 11 facing toward the movable section 15 so as to surround the opening 18. Under the action of the labyrinth 113, it is made possible to reduce an amount of air leaking through the gap between the wall surfaces of the respective stationary and movable sections 11 and 15. Thus, there can be provided the electronically controlled type throttle valve capable of controlling an amount of inflow air accurately in a range of from the fully closed position to the fully open position.

An example of an engine system, to which the invention is applied, will next be described with reference to FIG. 25.

Figure 25:
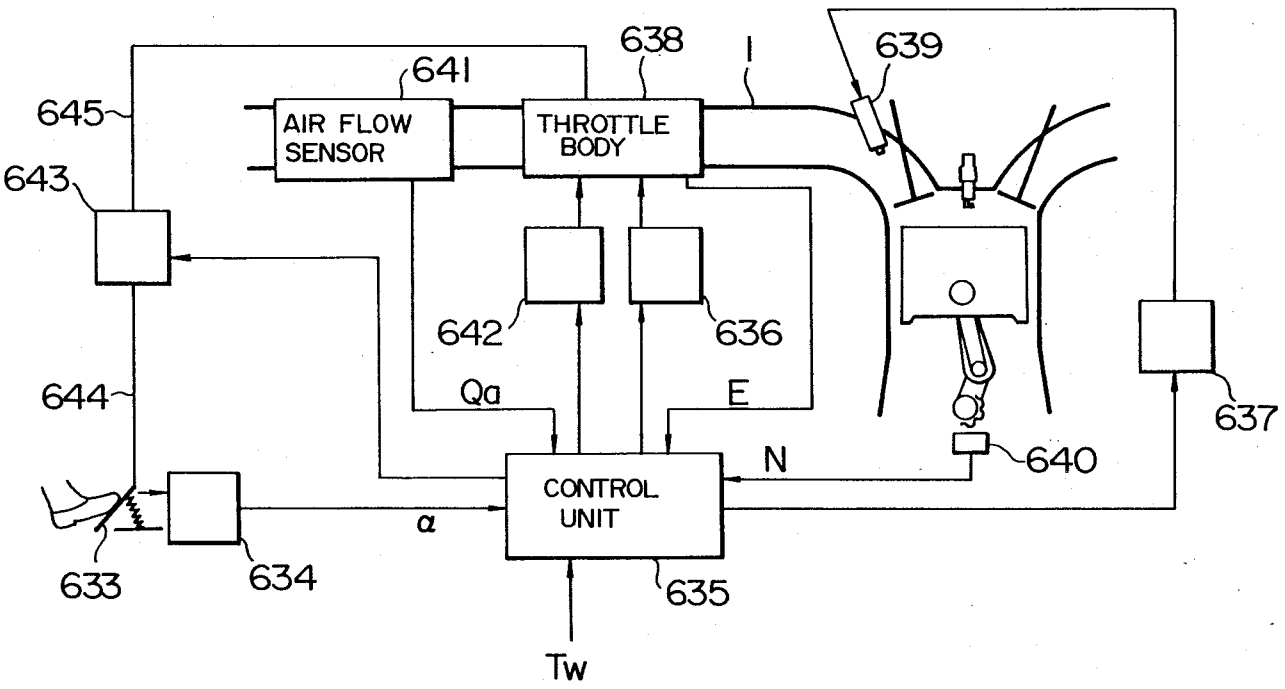
FIG. 25 is a block diagram for explanation of an engine system to which the electronically controlled type throttle valve for internal combustion engines, according to the invention is applied.

In FIG. 25, the reference numeral 633 denotes an accelerator pedal; 634 an accelerator sensor; 635 a control unit; 636 a throttle drive circuit; 637 a fuel-injection-valve drive circuit; and 638 a throttle chamber. The throttle chamber 638 is provided with an electronically controlled type throttle valve which is so driven as to be opened and closed, by a ultrasonic motor like one, for example, described previously with reference to the embodiment illustrated in FIG. 1. The reference numeral 639 designates a fuel injection valve; 640 a crank-angle sensor; 641 an air flow sensor; 642 an electromagnetic-solenoid drive circuit; 643 wire connecting means; and 644 and 645 accelerator wires. The wire 644 is interlocked with motion of the accelerator pedal 633, while the wire 645 is interlocked with the movable section 15 (see FIG. 1) within the throttle body 638. The connecting means 643 comprises a kind of clutch operated electromagnetically, and serves to connect the wires 644 and 645 to each other when an electric control signal is given to the connecting means 643.

Motion of the accelerator pedal 633 is detected by the accelerator sensor 634 in such a manner that an amount of depression $\alpha$ of the accelerator pedal 633 is inputted to the control unit 635.

On the other hand, the control unit 635 has inputted thereto various data including engine temperature $T_W$ from a water-temperature sensor (not shown), engine rotational speed N from the crank-angle sensor 640, suction air flow rate Qa from the air flow sensor 641, throttle opening degree E from the throttle chamber 638 and so on. On the basis of these data, the control unit 635 executes a predetermined calculation, to supply a drive signal to the ultrasonic-motor drive circuit 636. On the basis of the drive signal, the drive circuit 636 applies driving voltage to the ultrasonic motor within the throttle body 638. Control is done in such a manner that the throttle opening degree due to the application of the driving voltage is obtained correspondingly to the data $\alpha$ given by the accelerator pedal 633. Thus, a fuel injection signal is supplied to the fuel-injection-valve drive circuit 637 to execute the control of the fuel supply amount.

At this time, feedback cotnrol to the fuel supply amount is executed by inputting of the data Qa.

Further, in parallel with the controls described above, the control unit 635 has inputted thereto an actual throttle opening degree on the basis of the data E to execute feedback control to the throttle opening degree, thereby monitoring coincidence of the actual throttle opening degree with a target throttle opening degree from the accelerator pedal 633. If it is judged that crumbling exceeding a predetermined value appears in the coincident state, a signal is supplied to the electromagnetic-solenoid drive circuit 642 to interrupt the supply of current to the electromagnetic solenoid 612 within the throttle chamber 638, thereby exercising a fail-safe function. Thus, the throttle opening degree is brought to the fully closed state, and a connecting signal is outputted to the wire connecting means 643 to connect the wires 644 and 645 to each other.

As a consequence, the throttle opening degree can be controlled directly by the accelerator pedal 633 through the wires 644 and 645. Thus, continuation of minimum running of the automotive vehicle at the time the fail-safe function is operated, that is, a so-called limp-home is made possible.

Figure 26:
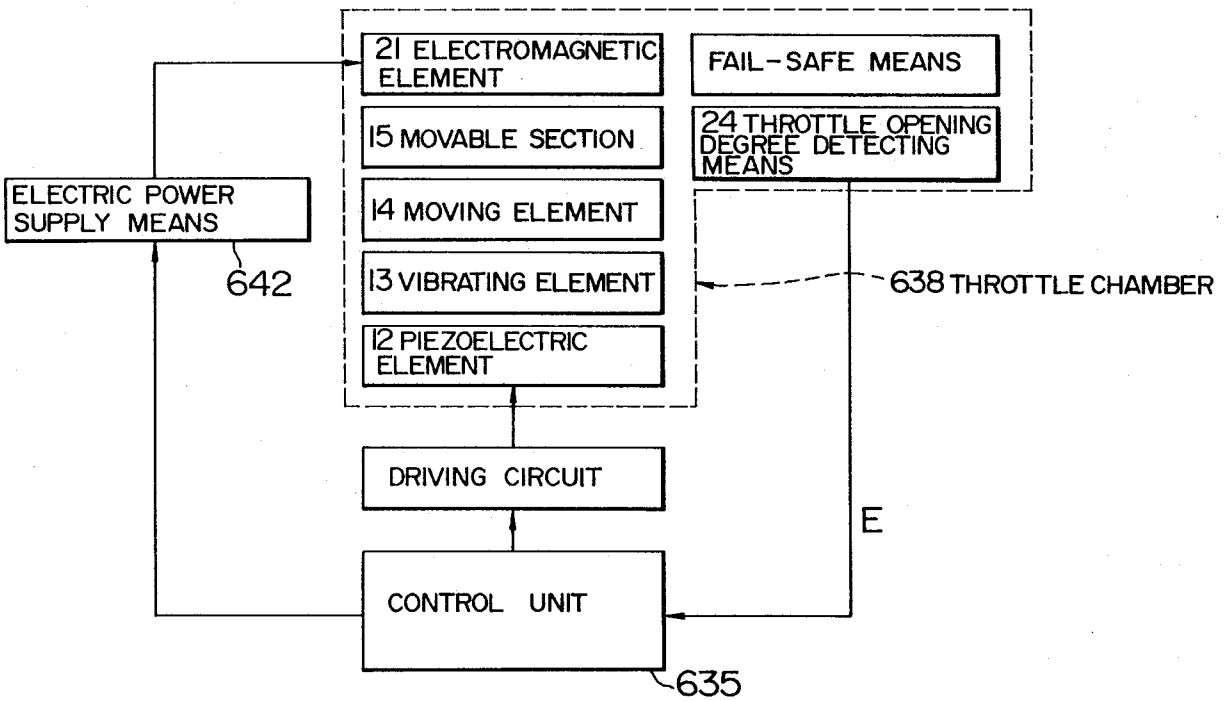
FIG. 26 is a block diagram of a control section of the engine system.

FIG. 26 shows a control block diagram of the above-described engine system. The throttle chamber 638 comprises a valve body composed of the piezoelectric element 12, the vibrating element 13, the moving element 14 and the movable section 15, as shown, for example, in FIG. 1, the electromagnetic solenoid 21 for fail-safe, and the throttle-opening-degree detecting means 24. Normally, driving voltage is applied to the piezoelectric element 12, while the electromagnetic solenoid 21 is maintained energized, so that the throttle opening degree is controlled. Abnormally, however, the electromagnetic solenoid 21 is deenergized so that the state is brought to the fail-safe state.

Figure 27:
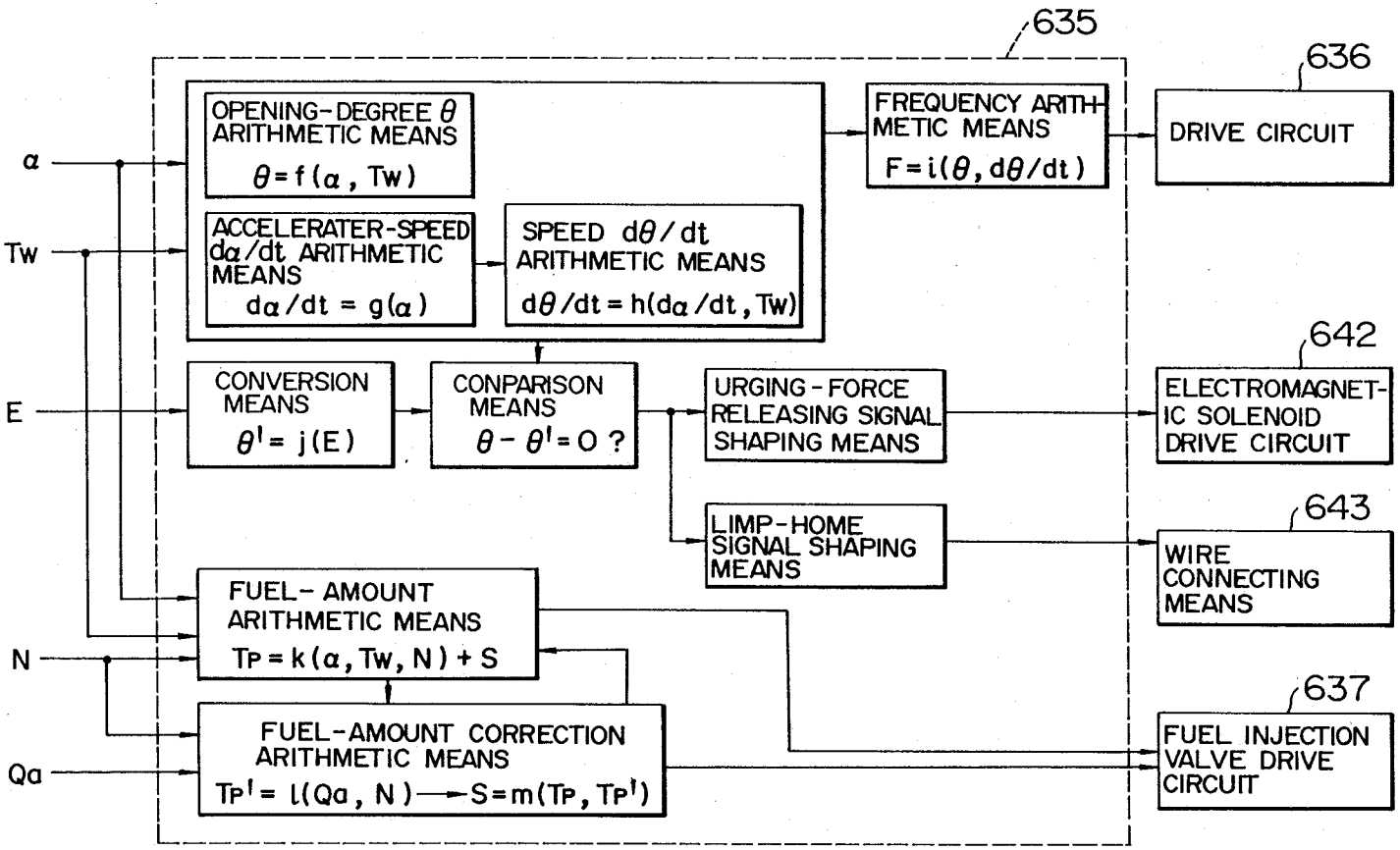
FIG. 27 is a block diagram of a control unit of the engine system.

FIG. 27 is a view for explanation of the control unit 635. The control unit 635 comprises opening-degree $\theta$ arithmetic means for calculating a target accelerator opening degree $\theta$ on the basis of the depression amount data $\alpha$ from the accelerator pedal 633 and the water temperature data $T_W$ from the water temperature sensor, and speed $d\theta/dt$ arithmetic means for calculating a rate of change $d\theta/dt$ of the data $\theta$ on the basis of the data from accelerator-speed $d\alpha/dt$ arithmetic means for calculating a rate of change $d\alpha/dt$ of the data $\alpha$. On the basis of signals from these means, the control unit 635 actuates frequency arithmetic means for calculating frequency F of a signal to be supplied to the ultrasonic-motor drive circuit 636.

In parallel with the above, the control unit 635 has inputted thereto the data E from the opening-degree detecting means 24, to calculate an actual throttle opening degree $\theta'$ by conversion means. The actual throttle opening degree $\theta'$ is compared with the target throttle opening degree $\theta$ by comparison means. If a deviation between them is displaced from zero by a predetermined value or more, urging-force releasing signal shaping means and limp-home signal shaping means are driven to suspend supply of current to the electromagnetic solenoid 21. Thus, the fail-safe function is exercised, and the signal is supplied to the wire connecting means 643 to connect the wires 644 and 645 to each other, thereby bringing the state to the limp-home state.

On the other hand, the control of the fuel supply amount is executed in the following manner.

The data $\alpha$, $T_W$ and N are first inputted to the control unit 635. On the basis of these data, a basic fuel injection pulse width Tp is calculated by the fuel-amount arithmetic means. On the other hand, the engine rotational speed data N and the suction air flow rate data Qa are inputted to the control unit 635. On the basis of these data, a fuel-amount correction value Tp' is calculated by fuel-amount correction arithmetic means. These signals Tp and Tp' are supplied to the fuel injection valve drive circuit 637, to control the fuel supply amount.

Figure 28:
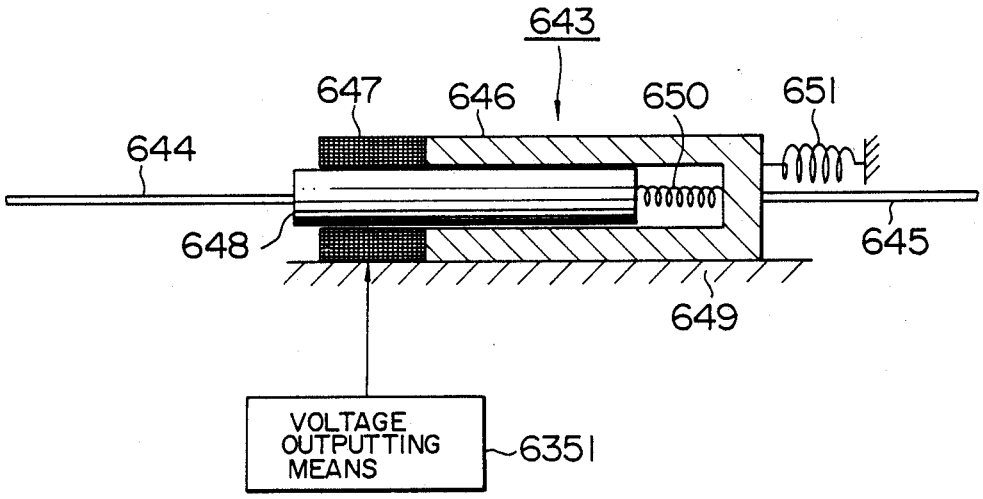
FIG. 28 is a cross-sectional view of an embodiment of wire connecting means of the control unit.

The wire connecting means 643 will next be described in detail with reference to FIG. 28. In FIG. 28, the reference numeral 646 denotes a guide member formed of magnetic material; 647 an electromagnet; 648 a plunger formed of magnetic material; 649 a sliding retainer portion; and 650 and 651 springs.

If it is now supposed that no current is supplied to the electromagnet 647, the plunger 648 is free with respect to the electromagnet 647 and the guide member 646. Accordingly, even if the accelerator pedal 633 (see FIG. 25) is operated and the wire 644 moves following the operation of the accelerator pedal 633, the movement is not transmitted to the wire 645.

If electric current is supplied to the electromagnet 647 from voltage outputting means 6351 within the control unit 635, the plunger 648 formed of magnetic material is magnetized and is united with the guide member 646 formed also of magnetic material. At this time, therefore, motion of the wire 644 is transmitted to the wire 645 as it is. Thus, the depression operation of the accelerator pedal 633 is transmitted to the throttle valve as it is, so that the limp-home is made possible. In this connection, the springs 650 and 651 are so arranged as to prevent the wires 644 and 645 from slacking.

According to this embodiment, it is possible for the electronic throttle system to have sufficient fail-safe functions, including the limp-home function.

As will be clear from the foregoing, the electronically controlled type throttle valve for internal combustion engines, according to the invention, has the following advantage. That is, the operational torque required for controlling the valve opening degree is small, thereby enabling the entire apparatus to be reduced in size. Thus, there is provided a superior attaching or mounting ability within the narrow engine room.

Further, since the motor serving as a driving source for the valve is accommodated in the stationary section, the motor is cooled by the suction air. Thus, the electronically controlled type throttle valve for internal combustion engines, according to the invention can be mounted to a position adjacent the engine, making it possible to provide a superior control response ability of the engine.

What is claimed is:

1. An electronically controlled type throttle valve for an internal combustion engine, said throttle valve being arranged within a suction passage of the engine and having an opening degree controlled in response to any one of a running condition of the engine to be controlled and an amount of operation of an accelerator pedal, to control an amount of suction air, said throttle valve comprising:

a stationary section fixedly mounted within said suction passage in concentric relation thereto and including a tubular member whose at least one end is closed, said stationary section having a peripheral wall whose outer surface cooperates with an inner peripheral surface of said suction passage to define therebetween a gas flow passage, said peripheral wall being formed with at least one pair of openings arranged in symmetrical relation to each other with reference to an axis of said peripheral wall, said openings being symmetrical in configuration to each other;

a movable section fitted in said stationary section in concentric relation thereto for sliding movement relative to said stationary section, said movable section having moving walls which correspond respectively to said openings formed in the peripheral wall of said stationary section, said moving walls being arranged in symmetrical relation to each other with reference to a rotary axis of said movable section, said moving walls being symmetrical in configuration to each other; and rotative driving means for imparting rotative driving force to said movable section, wherein a suction passage formed between said openings in said stationary section and said moving walls of said movable section is controlled in area by a position of said movable section relative to said stationary section.

2. An electronically controlled type throttle valve according to claim 1, wherein said rotative driving means is fixedly mounted to a part of said stationary section.

3. An electronically controlled type throttle valve according to claim 1, wherein said rotative driving means is constituted by a rotary electric motor.

4. An electronically controlled type throttle valve according to claim 3, wherein said rotary electric motor is a ultrasonic motor.

5. An electronically controlled type throttle valve according to claim 1, wherein said valve is accommodated in a surge tank of the internal combustion engine.

6. An electronically controlled type throttle valve according to claim 1, wherein said movable section is accommodated in the tubular member of said stationary section.

* * * * *